United States Patent [19]

Archer

[11] 4,375,835

[45] Mar. 8, 1983

[54] OIL PRODUCTION SYSTEM

[75] Inventor: Michael Archer, Bishops Stortford, England

[73] Assignee: The British Petroleum Company Limited, London, England

[21] Appl. No.: 218,420

[22] Filed: Dec. 19, 1980

[30] Foreign Application Priority Data

Dec. 21, 1979 [GB] United Kingdom ..... 7944142
Feb. 19, 1980 [GB] United Kingdom ..... 8005516

[51] Int. Cl.[3] ..... E21B 43/01

[52] U.S. Cl. ..... 166/339; 166/341; 166/353; 166/354; 166/357; 166/359

[58] Field of Search ..... 166/353, 354, 357, 359, 166/367, 362, 338, 339, 341, 344, 345; 55/164

[56] References Cited

U.S. PATENT DOCUMENTS

| | | | |
|---|---|---|---|
| 3,191,201 | 6/1965 | Richardson | 441/3 |
| 3,215,202 | 11/1965 | Pollard et al. | 166/341 |
| 3,223,164 | 12/1965 | Otteman | 166/362 X |
| 3,503,442 | 3/1970 | Dodd et al. | 166/359 X |
| 3,538,238 | 11/1970 | Delacour et al. | 166/359 X |
| 3,749,162 | 7/1973 | Anders | 166/354 |
| 3,791,442 | 2/1974 | Watkins | 166/359 X |
| 4,047,579 | 9/1977 | Wilckens et al. | 166/345 X |
| 4,097,069 | 6/1978 | Morrill | 166/344 X |
| 4,301,760 | 11/1981 | Cassone et al. | 166/354 X |

FOREIGN PATENT DOCUMENTS 1014879 12/1965 United Kingdom .

*Primary Examiner*—Stephen J. Novosad
*Attorney, Agent, or Firm*—Morgan, Finnegan, Pine, Foley & Lee

[57] ABSTRACT

An oil production system for producing oil at an offshore location comprises a floating storage vessel to receive the produced oil, the vessel having means for dynamic positioning and being connectable to a subsea well head by a riser and having means for separating the associated gas from the produced oil and employing the separated gas as fuel for the dynamic positioning.

Re-entry of the subsea well is effected by providing the riser with means for effecting a simultaneous stab connection with the production bore and hydraulic control system lines without orientation.

10 Claims, 12 Drawing Figures

64
66
67
59
69
60
61
30
62
58
56
52
54
50
25

71

72
80
82
74
76
78
84

80
82

OIL PRODUCTION SYSTEM

This invention relates to an oil production system for use at an offshore location.

In recent years a number of offshore oilfields have been located which are too small to be economically developed using a fixed production platform supporting a multiplicity of producing wells. However these oilfields are believed to contain significant amounts of recoverable oil and there is therefore a need for a production system that is less expensive than the fixed platforms referred to above.

It is an object of the present invention to provide an oil production system suitable for production from a single well.

Thus according to the present invention an oil production system suitable for use at an offshore location comprises a floating storage vessel to receive the produced oil and having means for dynamic positioning and a riser supported from the vessel and connectable at its lower end to a subsea well head, the vessel further having means for separating the oil and its associated gas and employing the latter as fuel to power the dynamic positioning means.

The riser can be in the form of a flexible hose capable of being left on the sea bed or can alternatively be of a relatively more rigid form and comprise sections of steel pipe joined endwise.

The riser can be in one of two alternative forms: (a) a flexible riser capable of being left on the sea bed and conveniently being made of a continuous length of spirally wound interlocking steel strip around an internal flexible sheath of synthetic rubber or (b) a relatively rigid riser made up of sections of steel pipe joined endwise and which when not in use is disconnected and stored in sections on the vessel.

The lower end of the flexible riser can be permanently joined to the sub sea well and when not in use the flexible riser can be lowered to the sea bed by means of a wire which can be connected to a surface buoy. To recommence use the riser can be picked up by the vessel and the upper end thereof connected to a rotating swivel on the vessel's side. The flexible riser can be kept constantly in a catenary form by means of the dynamic positioning of the vessel, to prevent contact with the sea bed.

The relatively rigid riser can conveniently be tensioned by means of a number of hydropneumatic tensioners connected to a travelling cursor in a moonpool in the vessel. With both forms of riser one or more hydraulic lines conveniently in the form of a bundle are attached thereto to control the sub sea valves.

The relatively rigid riser conveniently has a guidance skirt for engaging a corresponding surface on the sub sea well head and a hydraulic connector.

Conveniently the vessel is provided with means for stowing the riser sections (typically 60 feet in length) vertically.

The floating storage vessel can be a tanker, for example one of 50,000 DWT size.

Conveniently the vessel has a moonpool located, for example, in the mid section thereof and is provided with appropriate riser tensioning equipment and desirably also a mast or light derrick or the like.

The moonpool can be a steel tube through the center or near center of the vessel having a diameter slightly larger than the riser or skirt thereof and a funnel at the bottom of the hull to facilitate entry.

Desirably means is provided for centralizing the riser within the moonpool, for example, rollers working in channel irons.

The riser can have means at the lower end thereof for locating the position of the well head.

The means for locating the position of the well head is conveniently capable of being lowered through the riser from the floating vessel.

The riser can be connected to the well head by means of a connector assembly having means for simultaneous connection of the production bore and control system lines without the need for orientation.

The connector assembly can engage a re-entry hub which joins the production tubing to the annulus tubing and presents a connector pin interface to the connector assembly.

The tanker can be provided with conventional process equipment although it may be convenient to include a flow tank as the final stage of oil/gas separation to act as an oil cooler.

Desirably the process equipment is operated to produce a stabilized crude oil of, e.g. TVP 12 psi maximum and of a temperature such that the temperature difference across the vessel's plates does not exceed 160° F.

According to another aspect of the present invention a method of producing oil at an offshore location comprises employing a dynamically positioned floating storage vessel to receive the produced oil from a riser connected at its lower end to a subsea well head, the method involving separating the associated gas from the oil and using the separated gas as fuel to power the dynamic positioning means.

Conveniently the riser is of the guidelineless and orientationless type.

Conveniently the riser is provided with one or more hydraulic lines conveniently in the form of a bundle to operate the well head valves and downhole safety valves.

The invention is illustrated by reference to the accompanying drawings in which

Figure 1:
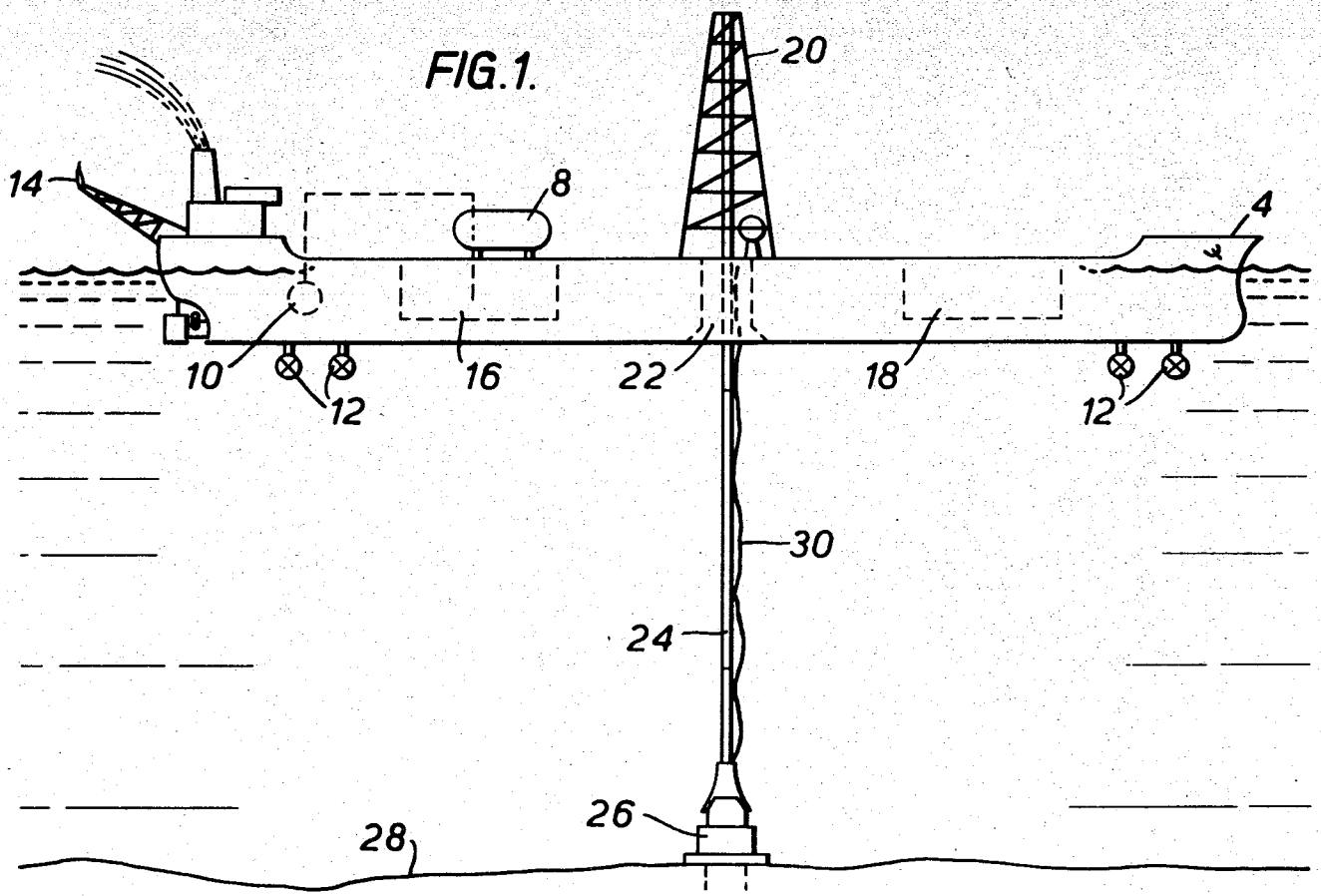
FIG. 1 is a vertical section showing a steel production system comprising a dynamically positioned tanker and production riser at an offshore location.
Figure 2:
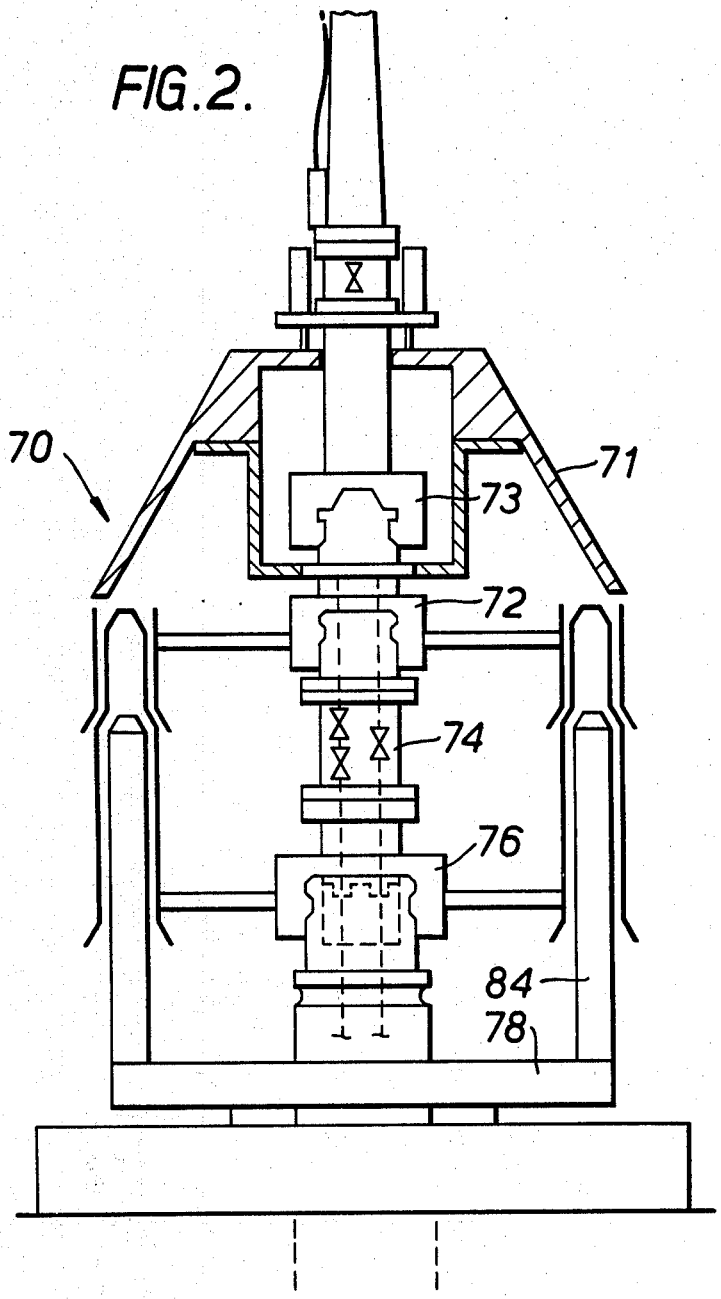
FIG. 2 is a vertical section partly in elevation of the subsea well head assembly comprising riser connector, re-entry hub, master valve block, well head connector and drilling well head with permanent guide base.

Referring to FIG. 1 the production system comprises a tanker 4 provided with conventional production processing equipment such as oil/gas separators 8. The tanker is dynamically positioned by four thrusters 12 any three of which are sufficient to maintain position, and comprise electric motors with variable pitch propellers. Separated gas not used in boilers 10 to raise steam for the electrical power for the thrusters 12 for the dynamic positioning is disposed of at flare 14. Stabilized crude oil is stored in tanks 16. Tanks 18 are also provided for segregated ballast. The tanker 4 has a production riser handling derrick 20 and moonpool 22. The steel production riser 24 extends through the hull of the tanker to a production well head 26 on sea bed 28. Extending along the length of the riser 24 is a bundle of control umbilical cables 30 to operate the well head valves and downhole safety valve once the riser has been connected to the well head.

Referring to FIGS. 2 and 7 to 9 the well head assembly indicated generally by numeral 70 comprises a production riser connector assembly 71 which includes surface activated hydraulic riser connector 73, re-entry hub 72, master valve block 74, well head connector 76, and drilling well head and permanent guide base 78.

A service riser 80 is provided with guide funnels 82 which engage guide posts 84 on the permanent guide base 78.

The re-entry hub 72 joins the production tubing with the annulus and presents an interface to the riser connector assembly 71. The latter is designed to allow simultaneous connection of the production bore and control system lines without the need for orientation. This is achieved by the control system circuits being concentric with the production bore. The re-entry hub has a series of horizontal circumferential grooves 75 which, when engaged with the riser, communicate with the hydraulic lines and thereby complete the circuit between the hydraulic lines and the bores in the well head for the hydraulic fluid.

The system described in FIGS. 2 and 7 to 9 has the following features:

(a) guidelineless and orientationless re-entry facility (FIG. 2), (b) a detachable re-entry hub so that hub can be replaced if damaged without killing the well and concentric re-entry and vertical annulus access (FIG. 2), (c) the main interfaces are the master valve block with the service riser and the riser connector assembly with the re-entry hub.

Figure 3:
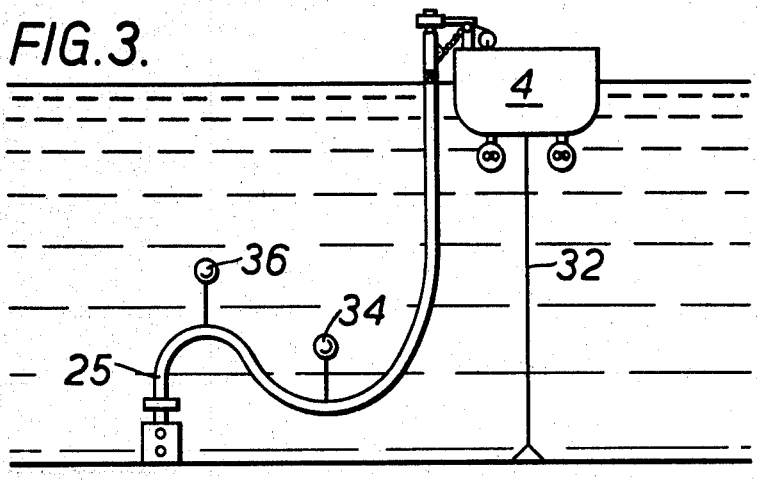
FIGS. 3, 4 and 5 are simplified vertical elevations showing the flexible riser in different modes of operation: production mode (FIG. 3) and alternative shutdown modes (FIGS. 4 and 5)
Figure 4:
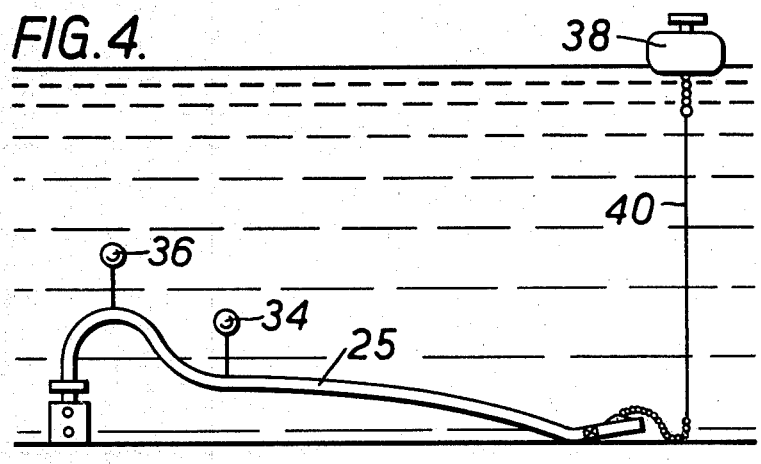
Figure 5:
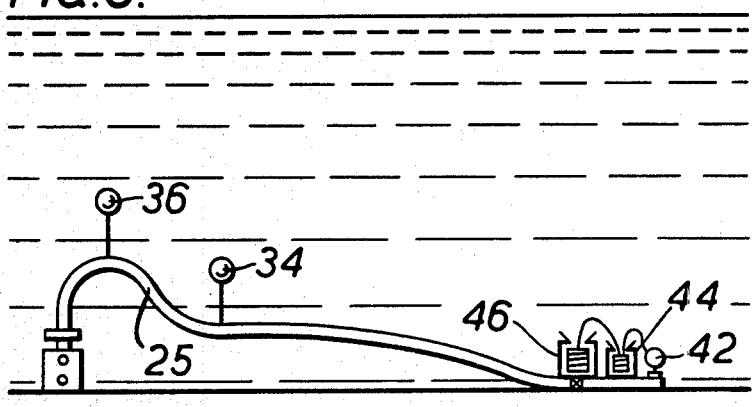

Referring to FIGS. 3 to 5 a tanker 4 maintained on station by dynamic positioning employs a taut wire 32 employing sensors of known type to detect deviations from the vertical for control of the dynamic positioning system. The flexible riser 25 employs buoyancy chambers 34 and 36 to prevent contact of the riser with the sea bed and thereby reduce wear.

In the shutdown mode shown in FIG. 4 the end of the riser 25 is located by buoy 38 at the end of 2 inch diameter wire 40. In this mode chambers 36 and 34 serve to keep the riser from contacting the subsea well head.

In FIG. 5 is shown an alternative shut down mode in which a sonically releasable recall buoy 42 is connected to a light nylon line in cannister 44 which is in turn connected to heavy nylon line in canister 46.

Figure 6:
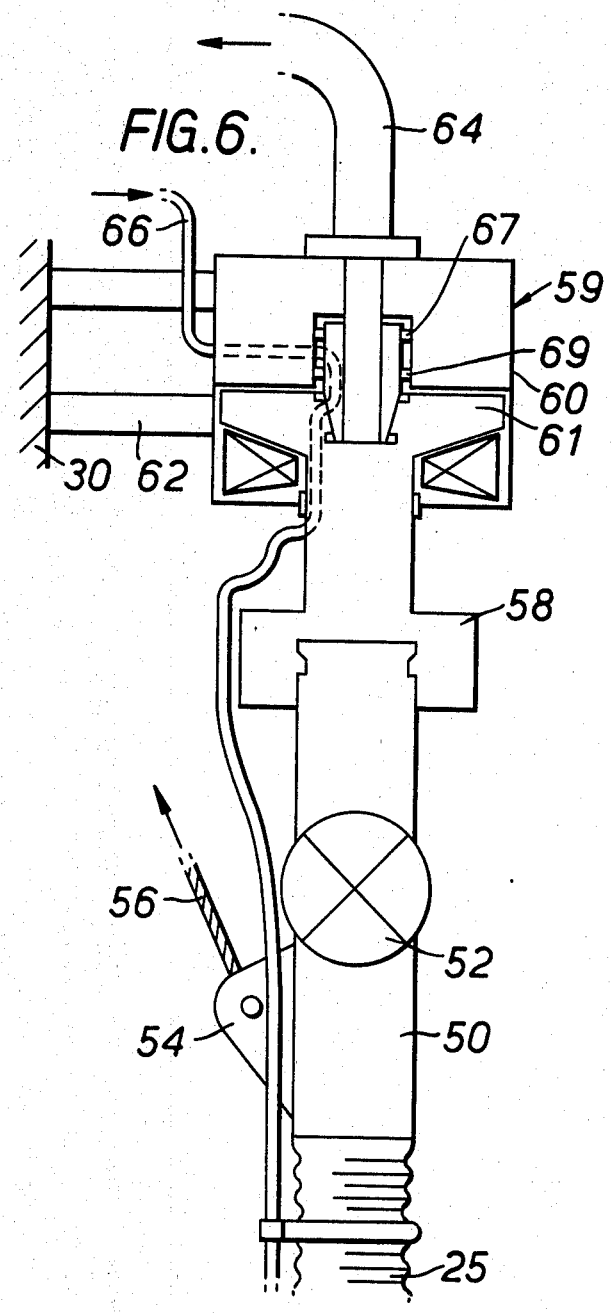
FIG. 6 is a vertical section through a high pressure swivel for use at the upper end of the flexible riser.
Figures 7, 8, 9:
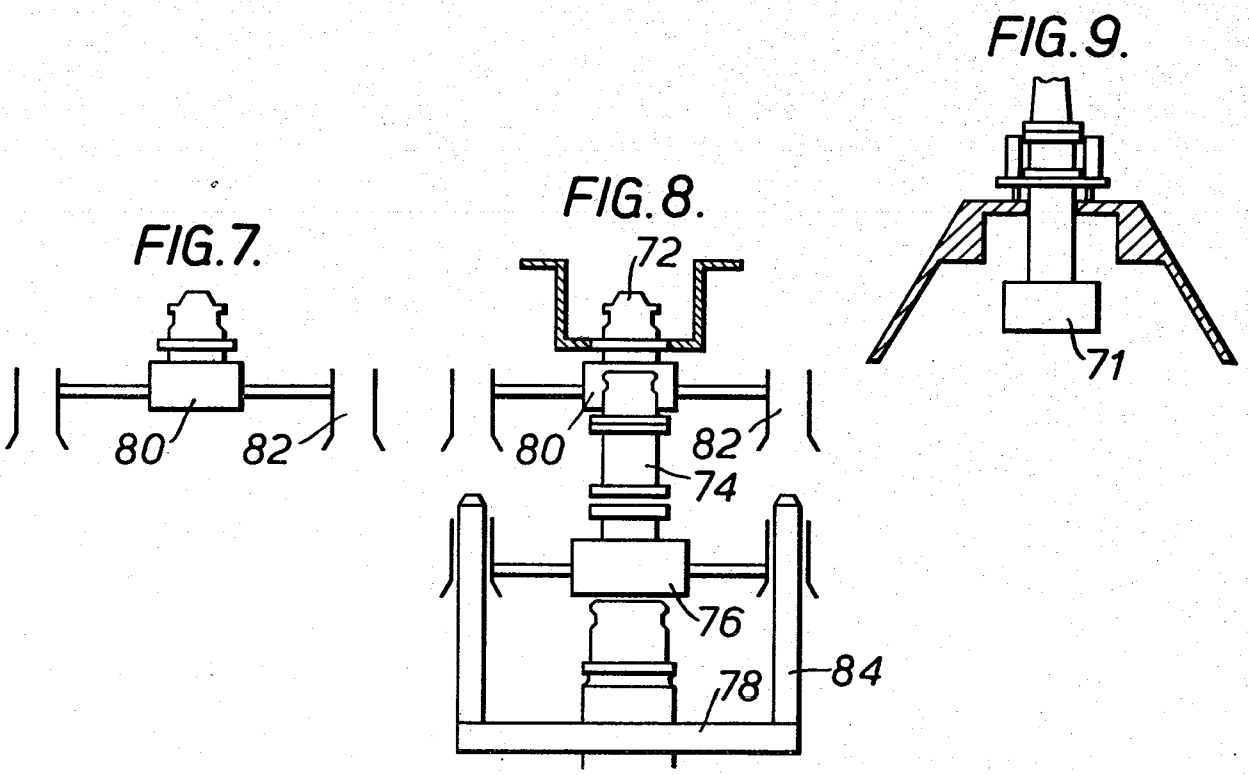
FIGS. 7, 8 and 9 are simplified elevation drawings showing the various components shown in FIG. 2 with their various interfaces.

In FIG. 6 the upper end of the flexible riser 25 which comprises flexible hose, for example, of the Coflexip type, is connected to a short steel tube 50 including a manual gate/ball valve 52. Attached to an eye on lug 54 on tube 50 is a retrieval line 56. The upper end of tube 50 is enclosed within a hydraulic connector of known type 58 which in turn is connected to a high pressure swivel indicated generally by numeral 59 and comprising an upper portion 60 which also forms a housing within which lower portion 61, which is attached to the connector 58, is located. Portions 60 and 61 can rotate with respect to each other about a vertical axis. Portion 60 is supported on the side of tanker 30 by struts 62. From the swivel 59 a line 64 takes produced fluids to oil/gas separators (not shown). A line 66 for hydraulic control of subsea equipment is also shown.

Located between portions 60 and 61 are seals 67 and 69.

Figure 10:
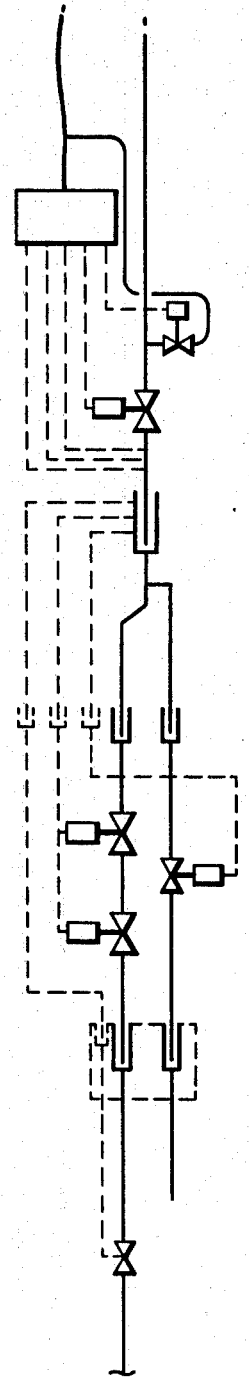
FIGS. 10 and 11 are schematic drawings of the main valves and controls and concentric stab respectively.
Figure 11:
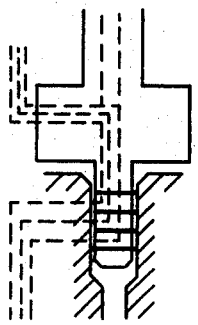

FIGS. 10 and 11 show the main valves and controls but not the controls to hydraulic connectors and jacking systems and the concentric stab re-entry connection.

The controls pass through the concentric re-entry stab (FIGS. 10 and 11) and the dedicated controls are from surface or through subsea relays.

Figure 12:
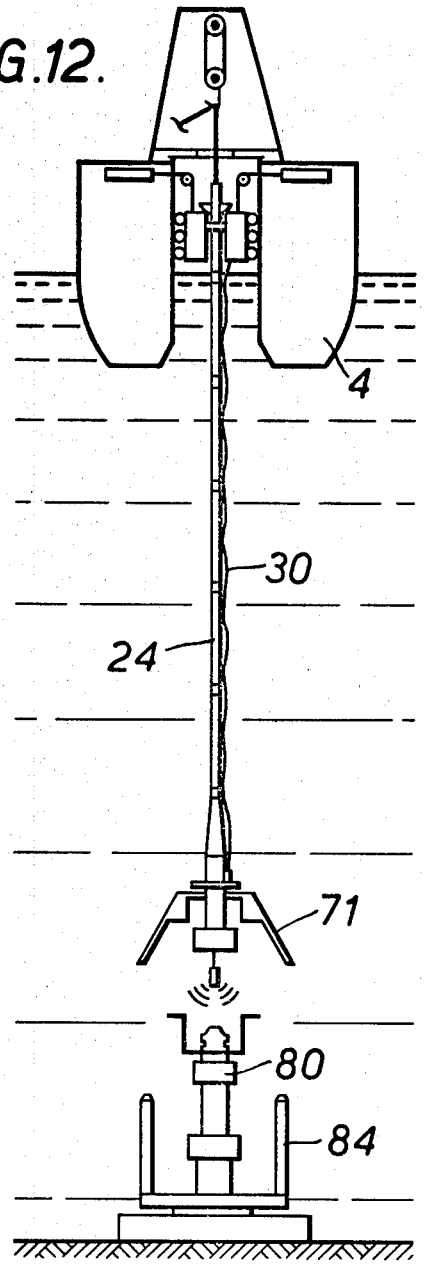
FIG. 12 is a vertical elevation showing the riser just about to re-enter the subsea well head assembly.

Referring to FIG. 12 the production riser is made of steel pipe of 4 inch to 5 inch nominal ID in 50 feet lengths. The riser couplings have a stab make up and an anti-rotation device. The handling of the riser is as follows: with tanker 4 offset, the connector assembly 71 is run to 15 feet above re-entry hub 72. The surface suspension system and tensioners are then connected. TV and/or Sonar is then run through pipe and the tanker 4 moves over the well. Final re-entry is made employing the tensioners.

I claim:

1. An oil production system suitable for use at an offshore location comprising a floating storage vessel to receive the produced oil, the vessel having means for dynamic positioning, a riser supported from the vessel and connectable at its lower end to a subsea well head, the vessel further having means for separating the oil and its associated gas and employing the latter as fuel to power the dynamic positioning means.

2. An oil production system as claimed in claim 1 wherein the riser is sufficiently flexible to be capable of being disconnected from the vessel and left on the sea bed and recovered from the sea bed for reuse.

3. An oil production system as claimed in claim 2 wherein the riser is joined at one end to a subsea well head and at the other end to a swivel on the vessel.

4. An oil production system as claimed in claim 2 wherein the dynamic positioning means of the vessel is controlled so as to maintain the riser in the form of a caternary to reduce contact with the sea bed.

5. An oil production system as claimed in claim 1 wherein the lower end of the riser has a flared skirt for engaging a corresponding surface on the sub sea well head to align the riser with the well production bore.

6. An oil production system as claimed in claim 5 including one or more hydraulic control lines and wherein the well head and the lower end of the riser are provided with co-operating means for effecting a simultaneous stab connection of the production bore and hydraulic control lines.

7. An oil production system as claimed in claim 6 wherein to effect said simultaneous connection the bores for the hydraulic control system are concentric with the production bore.

8. An oil production system as claimed in claim 5 wherein the lower end of the riser further includes a surface controlled hydraulic connector for connecting the riser to the subsea well head after alignment.

9. An oil production system as claimed in claim 5 wherein the riser has means at the lower end thereof for locating the position of the well head.

10. A method of producing oil at an offshore location which method comprises employing a dynamically positioned floating storage vessel to receive the produced oil from a riser connected at its lower end to a subsea well head, the method involving separating the associated gas from the oil and using the separated gas as fuel to power the dynamic positioning means.

* * * * *